United States Patent [19]

Watkins

[11] 4,374,595

[45] Feb. 22, 1983

[54] METAL TO METAL SEALED JOINT FOR TUBING STRING

[75] Inventor: Bruce J. Watkins, Palos Verdes Estates, Calif.

[73] Assignee: Hughes Tool Company, Houston, Tex.

[21] Appl. No.: 159,754

[22] Filed: Jun. 16, 1980

[51] Int. Cl.[3] ..... F16L 39/00

[52] U.S. Cl. ..... 285/137 A; 285/334.2; 285/356; 285/363; 285/138; 29/157 R

[58] Field of Search ..... 285/137 A, 138, 137 R, 285/334.2, 356, 363; 166/367; 29/237, 157 R

[56] References Cited

U.S. PATENT DOCUMENTS

| | | | |
|---|---|---|---|
| 1,821,867 | 9/1931 | Wilson | 285/334.2 |
| 3,189,098 | 6/1965 | Hueber | 285/137 A |
| 3,208,773 | 9/1965 | Boudrie | 285/356 X |
| 3,229,723 | 1/1966 | Janton | 285/371 |
| 3,280,908 | 10/1966 | Todd | 285/137 A |
| 3,354,951 | 11/1967 | Savage et al. | 285/137 A |
| 4,067,385 | 1/1978 | Schwager et al. | 285/137 A |

FOREIGN PATENT DOCUMENTS

| | | | |
|---|---|---|---|
| 2832220 | 1/1980 | Fed. Rep. of Germany | 285/137 A |

*Primary Examiner*—Dave W. Arola

*Attorney, Agent, or Firm*—Robert A. Felsman; Guy Porter Smith

[57] ABSTRACT

A subsea well apparatus having an improved means of axially connecting the plurality of tubing string sections disposed about each riser conduit section.

The subsea well apparatus has a riser conduit section with a mating flange at each end, tubing string receiving orifices disposed about the mating flanges, and a tubing string section with its ends disposed within an orifice in each mating flange. Further, the end portions of the tubing string section are shaped for free axial movement within each orifice and there is provided a means for axially adjusting the position of each tubing string end portion in order to selectively adjust the position of each tubing string end surface relative to the end surface of the adjacent mating flange.

The end portions of the tubing string sections may be provided with an outwardly-extending radial flange, and the axial adjusting means may be an annular ring circumventing the tubing string section and movably-attached to the riser mating flange by threaded engagement.

15 Claims, 6 Drawing Figures

-12-

METAL TO METAL SEALED JOINT FOR TUBING STRING

BACKGROUND OF THE INVENTION

I. Field of the Invention

The invention relates to subsea well risers, particularly to improved tubing string connections, and more particularly to adjustable metal to metal tubing string joints.

II. Description of the Prior Art

In the oil well industry, certain assemblies have been used for drilling and then producing oil wells in subsea locations. Generally, such assemblies include a riser for carrying a string of drill pipe or for flowing well production fluids upwardly.

The riser is made up of a plurality of riser conduit sections with mating flanges at each end for bolting connection to adjacent conduit sections. Normally provided with the riser conduit sections are various strings of tubing which run parallel and externally of the riser from the well platform down to the wellhead. These tubing strings serve a multitude of functions, including delivering fluids to be used in pumping the well fluids back up the riser, and providing hydraulic fluids to downhole controls. Each riser may have associated with it as many as twelve or more tubing strings.

These tubing strings are also provided in sections which are adapted to be disposed within orifices in their associated riser conduit mating flanges and to be connected to the axially-adjacent tubing string section in the adjacent riser conduit section. It can therefore be appreciated that when the riser conduit mating flanges are mated it is extremely important that the associated tubing string sections be circumferentially aligned and axially aligned so as to allow the tubing string sections to be properly connected and sealed.

In the past, one means of connection between axially-adjacent tubing string sections has been provided as shown in FIG. 3 which illustrates the male end, a, of an upper tubing string section, b, being in a stab-fit sealing engagement with the female end, c, of the lower adjacent tubing string section, d. Because the seal is a stab-fit engagement, the male and female members are free to move axially relative to each other. Such axial movement inevitably occurs during production operations and can produce an unsatisfactory seal. Furthermore, because of the frequent movement of the male and female members, a metal-to-metal seal cannot be used because it would quickly become worn and ineffective; and therefore, non-metal O-rings or other type non-metal seals are used.

The present invention overcomes and avoids the problems attendant to stab-engagement seals by providing a metal-to-metal seal with no axial positioning problems.

SUMMARY OF THE INVENTION

It is an object of this invention to provide a novel method of connecting axially-adjacent tubing string sections.

A further object of the invention is to provide a novel means of providing a metal-to-metal seal between tubing string sections.

Another object of this invention is to reduce the axial alignment problem associated with connecting tubing string sections.

Yet another object of this invention is to disclose a means for reducing the axial stress and strain normally imparted to tubing string connections.

These and other objects will be apparent to those skilled in the art from the following detailed description and are generally provided for by a subsea well apparatus having a riser conduit section with a mating flange at each end, tubing string receiving orifices disposed about the mating flanges, and a tubing string section with its ends disposed within an orifice in each mating flange. Further, the end portions of the tubing string section are shaped for free axial movement within each orifice and there is provided a means for axially adjusting the position of each tubing string end portion in order to selectively adjust the position of each tubing string end surface relative to the end surface of the adjacent mating flange.

The end portions of the tubing string sections may be provided with an outwardly-extending radial flange, and the axial adjusting means may be an annular ring circumventing the tubing string section and movably-attached to the riser mating flange by threaded engagement.

In a further embodiment of this invention, the tubing string sections associated with each riser conduit section have their respective ends disposed in tubing string receiving orifices which are circumferentially offset so that each end of each tubing string section is axially-disposed within its orifice and the intermediate portion of each tubing string section partially circumvents the riser conduit section.

DETAILED DESCRIPTION OF THE INVENTION

Figure 1A:
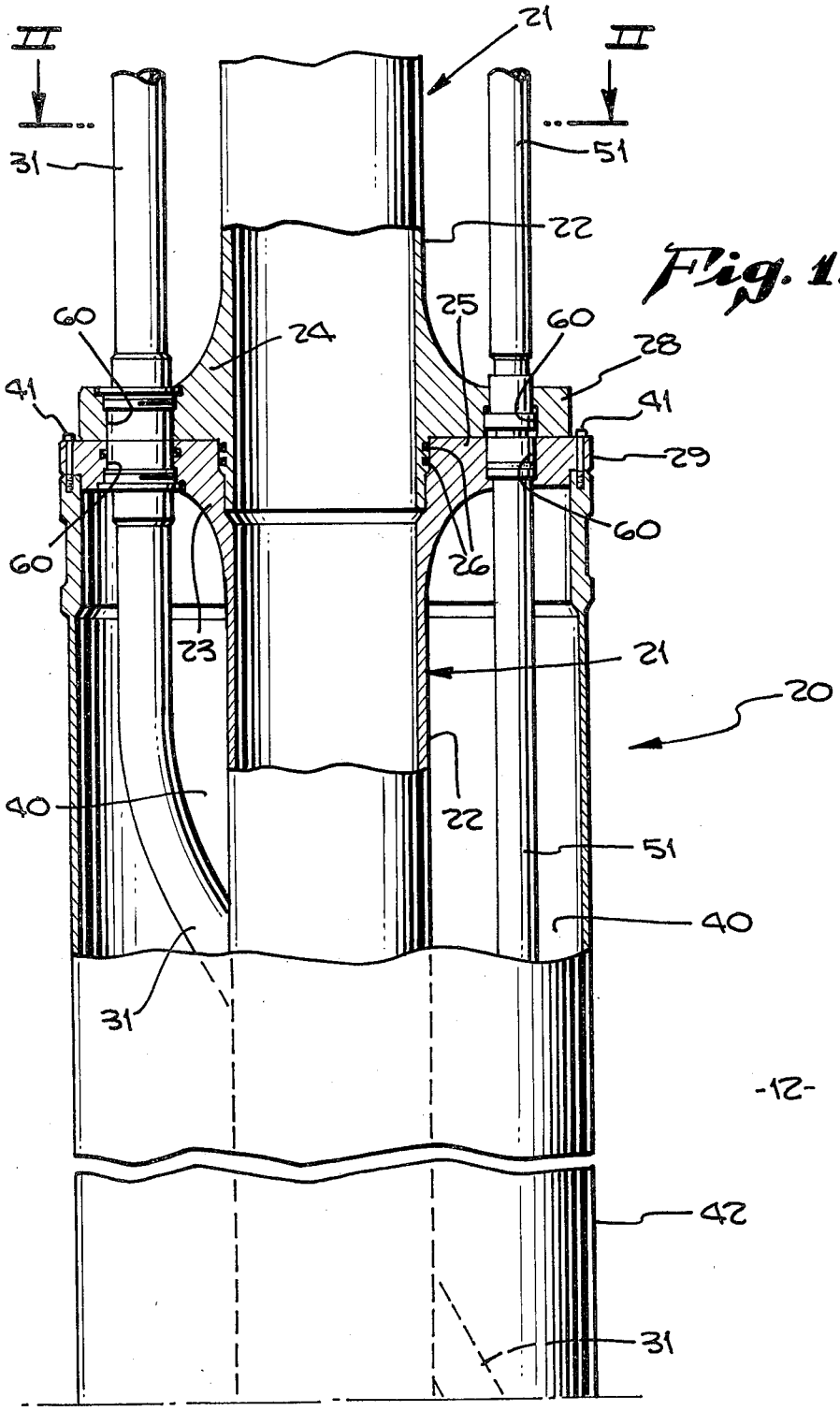
FIG. 1*a* is a partial cross-sectional view of the connection between adjacent riser conduit sections, particularly showing the upper portion of one riser.

A subsea well apparatus 20 extends from a floating vessel or platform (not shown) through a body of water 12 to a wellhead (not shown) positioned on the floor of the body of water. The subsea well apparatus 20 is formed of a plurality of riser conduit sections 21. These riser conduit sections are generally 40 to 50 feet long. It is contemplated that the subsea well apparatus associated with this invention could be used in drilling or production operations conducted at depths of 6000 feet or more below the water surface.

Each riser conduit section 21 has a cylindrical wall 22 having a top portion 23 and a bottom portion 24. At the end of the top portion 23 is a portion 25 of larger inside diameter which accepts the bottom portion 24 of the riser conduit section mounted directly above it. O-rings 26 seal the juntion of the two adjacent riser conduit sections.

The riser conduit sections 21 are also provided with a bottom riser mating flange 28 and a top riser mating flange 29 which project radially outward from the respective bottom and top portions of each riser conduit section. Each riser mating flange has end surfaces adapted for mating connection with the axially-adjacent riser mating flange end surface. Further, the riser mating flanges are provided with a plurality of tubing string-receiving orifices 60 circumferentially disposed about the riser conduit. These tubing string-receiving orifices are axially-disposed and serve to guide the various electrical and hydraulic tubing strings 31 and tubing string 51 carrying pressurized gas.

Figure 2:
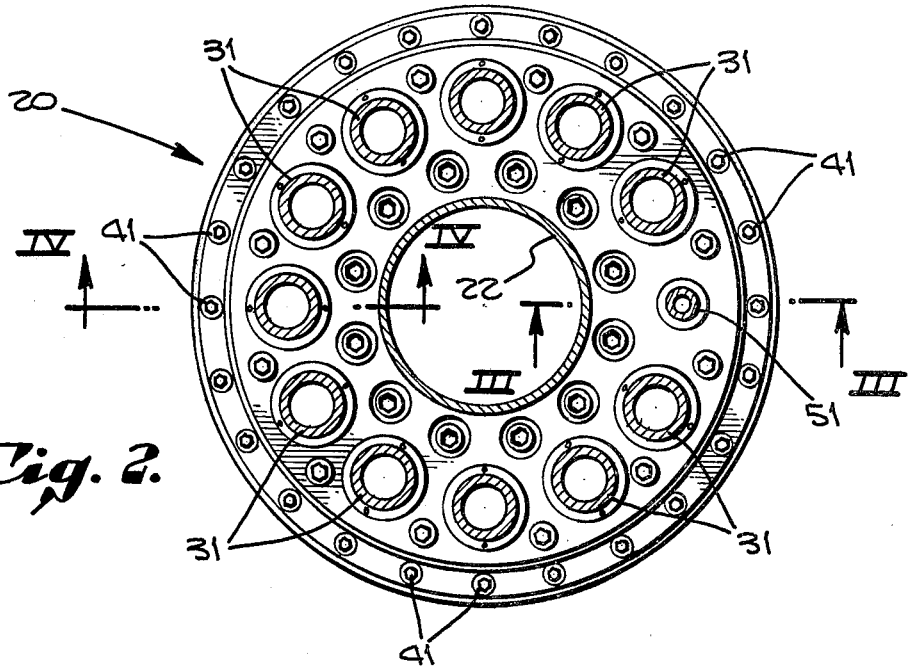
FIG. 2 is a cross-sectional view of the riser shown in FIG. 1 taken along the line II—II of FIG. 1*a*.
Figure 3:
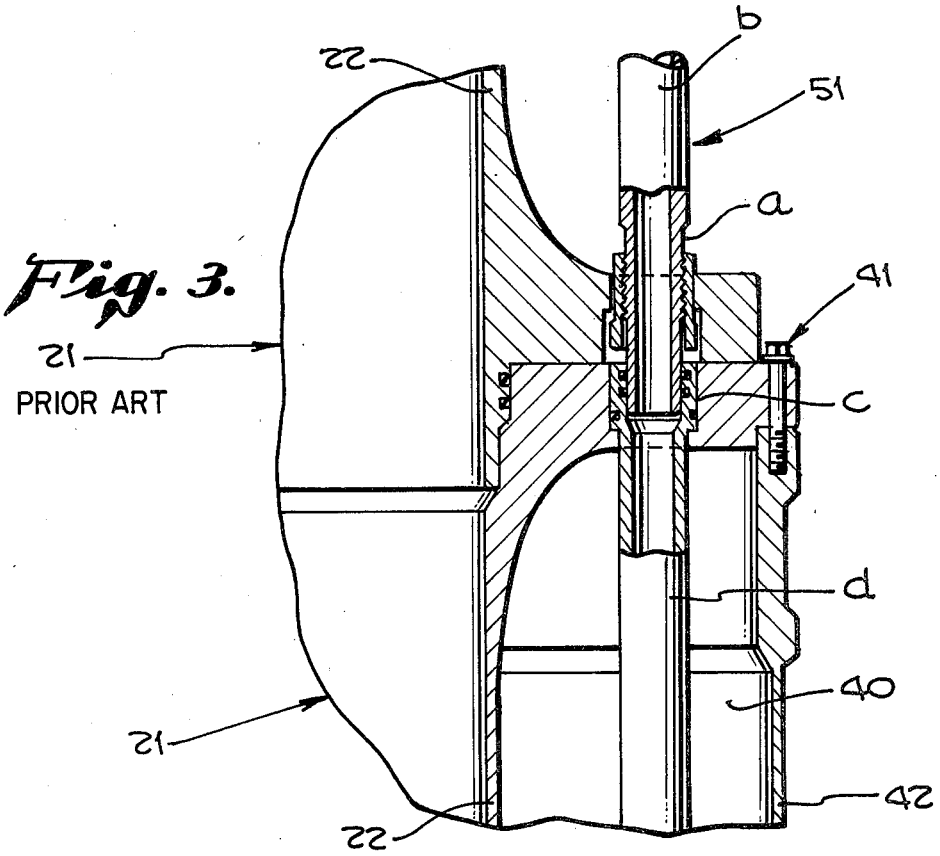
FIG. 3 is a detailed, partial cross-sectional view of a prior art connection construction.

As shown in FIG. 2, the riser conduit sections 21 are provided with a plurality of tubing strings 31 which in a typical embodiment serve as the hydraulic control lines for the choke and kill functions associated with the conventional blow-out preventer apparatus provided at the wellhead. The tubing string sections 31 are of approximately the same length as the riser conduit sections.

Figure 1B:
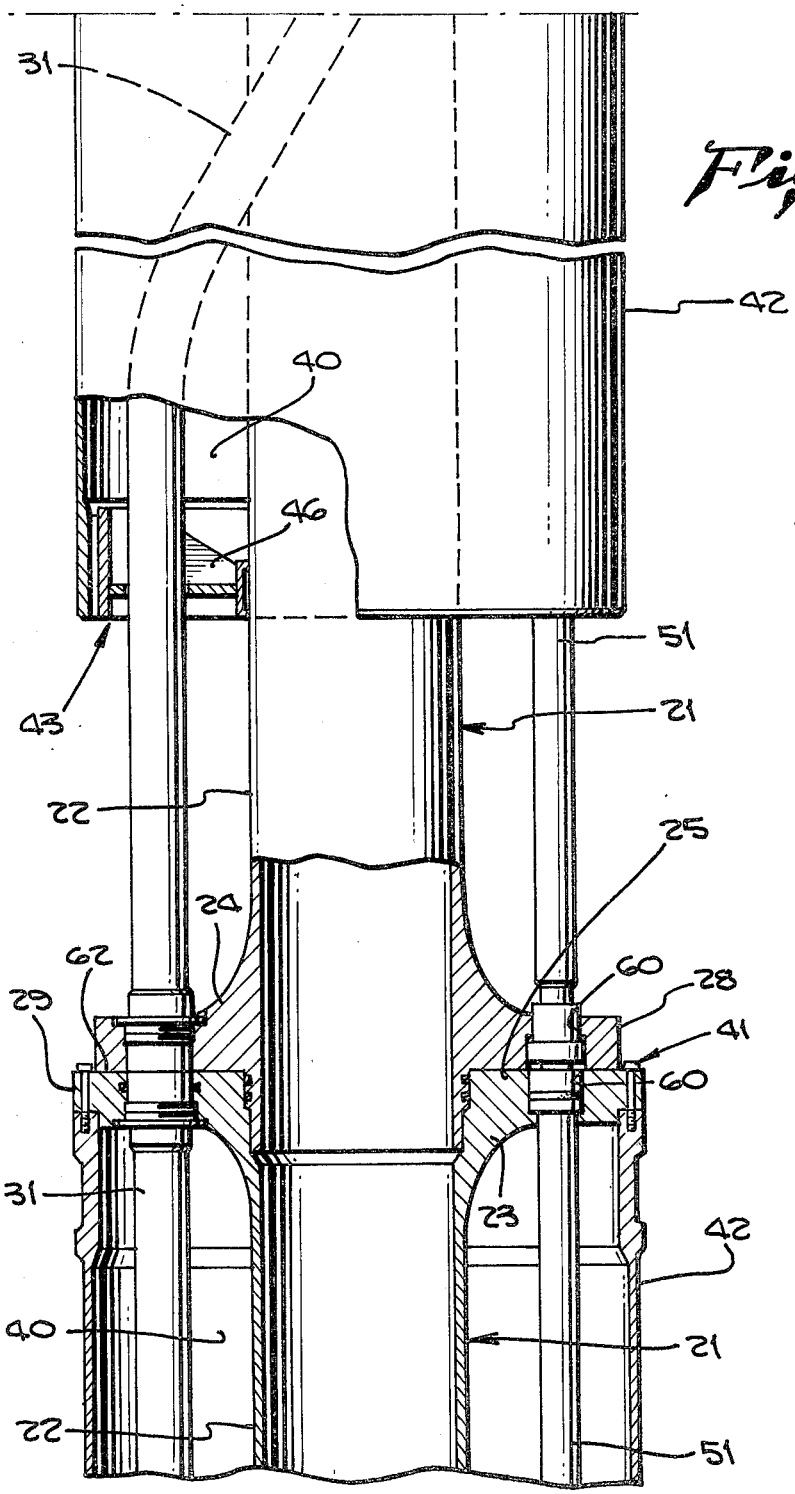
FIG. 1*b* is a partial cross-sectional view of the same connection shown in FIG. 1*a*, and particularly showing the lower construction of the upper adjacent riser conduit section.

A plurality of open bottom buoyancy air or gas receiving chambers and means for mounting them about and along said well apparatus are shown in the drawings. Such chambers 40 are formed by a cylindrical shell 42 attached to the top flange 29 by mounting bolts 41 to form an airtight seal therebetween. The mounting bolts 41 are located around the periphery of the flange 29 connecting the flange 29 to the cylindrical shell 42. The cylindrical shell 42 (FIG. 1*b*) is provided with a centralizer ring 43 mounted near the bottom of the shell 42 to maintain the shell 42 a fixed distance from the cylindrical wall of the riser conduit section 21. The centralizer ring 43 includes radial fins 46 extending from the outer surface of the riser conduit section 21 to the inside of the shell 42. There is no seal at the bottom of the chamber 40 and water is free to rise inside the chamber. The chambers 40 run almost the total length of each riser conduit section and all are substantially the same size.

Figure 5:
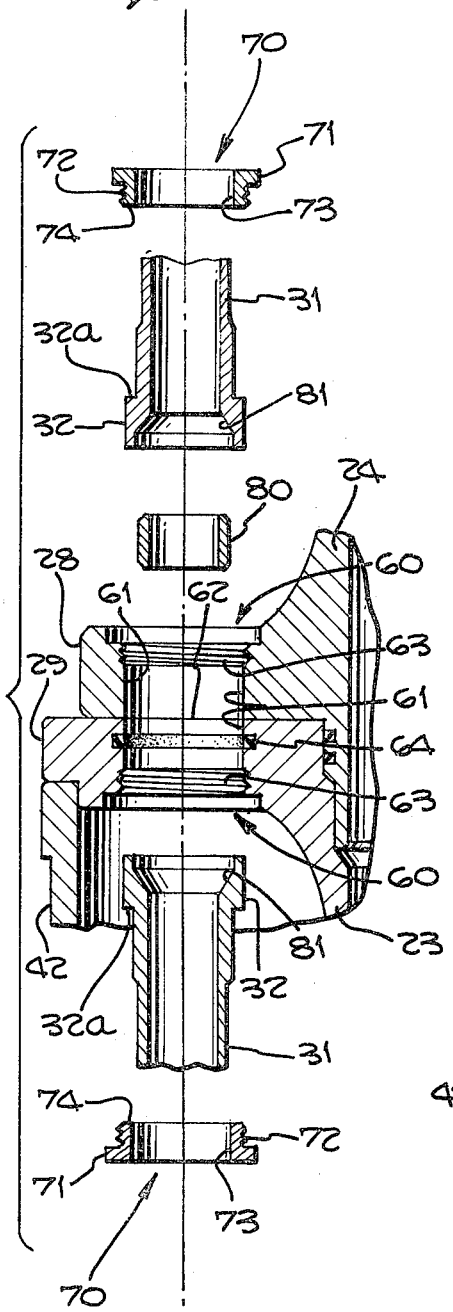
FIG. 5 is an exploded, cross-sectional view of the connection shown in FIG. 4.
Figure 4:
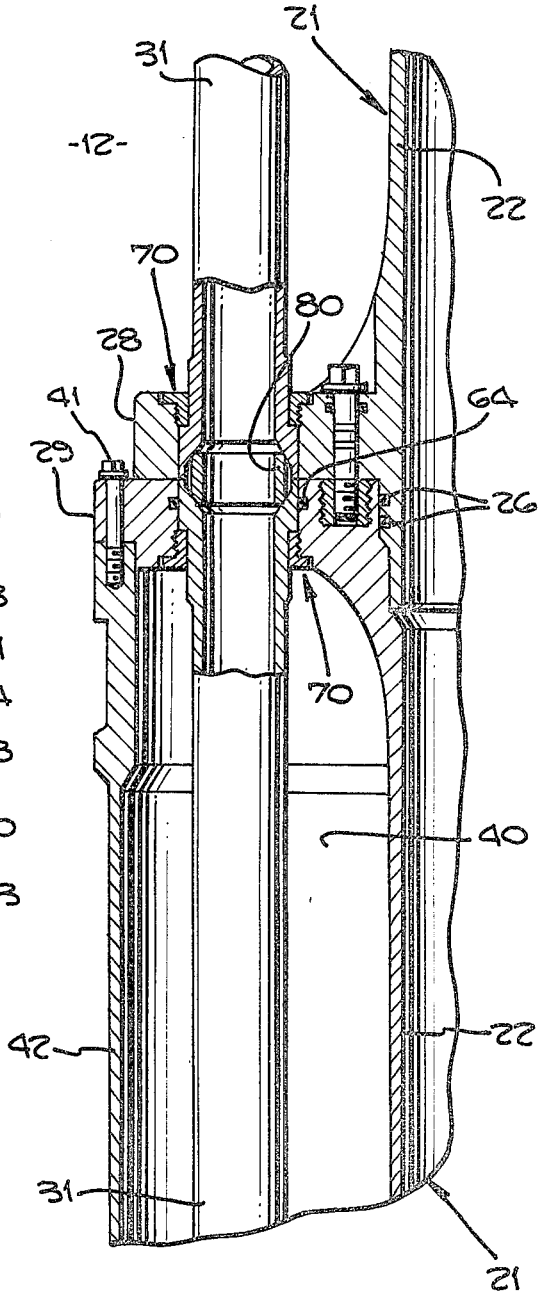
FIG. 4 is a detailed, partial cross-sectional view of the connection construction of this invention.

Referring now to FIGS. 4 and 5, the connection between axially-adjacent tubing string sections will now be described. FIG. 5 is an exploded view of the assembled connection shown in FIG. 4.

The associated structure for sealingly connecting the upper tubing string section with the lower tubing string section is essentially identical for the upper and lower sections. The flanges 28 and 29 are provided with axial tubing string-receiving orifices 60 having a straight annular section 61 extending from a point intermediate the orifice opening to the mating end surface 62 of the mating flange. From said intermediate point outward to the receiving end of the orifice 60, the orifice is provided with an internally threaded section 63.

The tubing string section 31 is provided with end portions as hereinafter described. Each end portion of the tubing string section 31 has an outwardly-extending radial flange 32 which is sized for free axial movement within the annular section 61 of the orifice 60. A shoulder 32*a* is provided for the transition between the radial flange 32 and the remaining portion of the tubing string section 31. This shoulder also serves as a means for receiving an axially-outward force at the end portion of the tubing string section, that is, an axial force tending to elongate the tubing string section. An annular ring or adjusting bolt 70 circumvents the tubing string section 31 at each end of the sections 31. This ring 70 has a head portion 71 for ease in handling and use, an externally threaded portion 72, and a smooth inner annular surface 73 for providing a sliding fit with the tubing string section 31. The leading end 74 of the ring 70 is adapted to abut against the shoulder 32*a* of the tubing 31 and thereby exert an axially-outward force on the shoulder to adjust the axial position of the ends of the tubing string section.

In the preferred practice of this invention, the end portion of the tubing string section is welded to the intermediate portion, and prior to this welding, the annular rings 70 are slipped onto the tubing string section 31. Also illustrated in FIG. 5, is an O-ring groove 64 within which an O-ring can be positioned for providing additional sealing.

Prior to adjacent riser conduit sections being connected, all of the associated tubing string sections are positioned as follows. Each tubing string section 31, with its two annular adjusting rings 70 in a loose circumventing position, has first one end slidably inserted into and through one of the receiving orifices 60. The tubing string section is capable of being inserted through the receiving orifice 60 because the enlarged end portion 32 is appropriately sized to slide through. After one end portion has been inserted, the other end portion is positioned in line with the other receiving orifice and the other end of the tubing string is positioned within the receiving orifice 60. After both end portions of the tubing string section 31 have been positioned within the two receiving orifices 60 of the riser conduit section 21, then one annular adjusting ring 70 is threaded within the threaded section 63 of the receiving orifice 60. The annular adjusting ring 70 is preferably threaded until the end surface of the tubing string section is flush with the adjacent mating flange end surface of the riser conduit flange. After one annular adjusting ring has been threaded and adjusted, then the second annular ring is threaded into its receiving orifice 60 and properly adjusted.

After all the tubing string sections have been connected to their associated riser conduct section and properly adjusted so that the tubing string end surfaces are flush with the adjacent mating flange end surfaces, the riser conduit section is ready for connection to a prior assembled and positioned riser conduit section. It will be apparent that because the annular adjusting rings 70 have been appropriately set the axial position of the tubing string sections will be proper with respect to the axially-adjacent tubing string section.

Finally, just prior to mating the adjacent riser conduit mating flanges, a conduit sleeve member 80 having tapered ends as seen in FIG. 5, is positioned between the tubing string sections. Each end of each tubing string section is provided with an annular inwardly tapered internal surface 81 (as seen in FIG. 5) which is adapted, by its taper, to apply a compressive axial force to said conduit sleeve member 80.

The conduit sleeve member 80 and the tubing string sections cooperate in the following manner. The conduit sleeve member 80 has an axial length somewhat greater than the axial distance between respective points on the adjacent annular internal surfaces 81. Thereby, when the upper and lower flanges 29 and 28 are brought into flush mating relationship, the annular ring member 80 is slightly compressed and thereby effects an excellent metal-to-metal type seal between it and the tubing string sections.

The use of the conduit sleeve member 80 increases the number of sealing surfaces, avoids relying solely on the seal created between the mating surfaces of the tubing string sections and of the flanges and provides a metal-to-metal seal of the adjacent tubing string sections.

A further embodiment of this invention provides that the pair of receiving orifices for each tubing string section be circumferentially offset (i.e. not in an axial line). This results in the tubing string section partially circumventing the riser conduit section. It is preferable that each tubing string section associated with each riser conduit section be equally circumferentially offset so that each tubing string section circumvents the riser conduit section an approximately equal angular amount. It will be obvious to those skilled in the art that in order to accommodate this offset arrangement, each tubing string section will need to be made longer by an appropriate amount. It is preferred that each tubing string section circumvent the riser conduit by an amount between about 170° and 190°, such as 180°.

The result of this circumferentially offset arrangement is that during actual subsea use of the riser and tubing strings, when ocean and weather conditions push, bend and otherwise jostle the subsea conduits, the rotated tubing string will behave like a spring and flex in response to the movement in the water.

If the tubing strings are positioned in their normal axial disposition, bending of the riser would result in axial tension or axial stress in the tubing string which, in time, weakens the tubing string and the tubing string connections.

A description and preferred embodiment of the invention has been presented and it will be understood by those skilled in the art that various modifications and embodiments of this invention may be made within the spirit and scope of the invention, which is defined by the following claims.

I claim:

1. In a subsea well apparatus having axially-adjacent riser conduit sections connected at end surfaces of their respective mating flanges, each conduit section having opposite end flanges each having axially-aligned tubing string-receiving orifices, and a tubing string section having its opposite ends within said tubing string-receiving orifices, the improvement comprising the provision of:

means for receiving an axially-outward force at each end of said tubing string section; and adjustable means for exerting an axially-outward force on said force-receiving means at each end of said tubing string section to adjust the axial position of the ends of the tubing string section relative each of said opposite end flanges.

2. In a subsea well apparatus having axially-adjacent riser conduit sections connected at end surfaces of their respective mating flanges, each conduit section having opposite end flanges each having axially-aligned tubing string-receiving orifices, and a tubing string section having its opposite ends within said tubing string-receiving orifices, the improvement comprising the provision of:

a surface element adapted to receive an axially-outward force at each end of said tubing string section comprising an outwardly-extending radial surface on the outer surface of each end of the tubing string section;

means for exerting an axially-outward force on each said surface member at each end of said tubing string section to adjust the axial position of the ends of the tubing string section.

3. In a subsea well apparatus having axially-adjacent riser conduit sections connected at end surfaces of their respective mating flanges, each having axially-aligned tubing string-receiving orifices, and a tubing string section having its opposite ends within said tubing string-receiving orifices, the improvement comprising the provision of:

means for receiving an axially-outward force at each end of said tubing string section; and adjustable means for exerting an axially-outward force on said force-receiving means at each end of said tubing string section to adjust the axial position of the ends of the tubing string section, said means comprising an annular ring circumventing each tubing string section being retained.

4. In a subsea well apparatus having axially-adjacent riser conduit sections connected at end surfaces of their respective mating flanges, each conduit section having opposite end flanges each having axially-aligned tubing string-receiving orifices, and a tubing string section having its opposite ends within said tubing string-receiving orifices, the improvement comprising the provision of:

a surface element adapted to receive an axially-outward force at each end of said tubing string section comprising an outwardly-extending radial surface on the outer surface of each end of the tubing string section; and means for exerting an axially-outward force on each said surface element at each end of said tubing string section to adjust the axial position of the ends of the tubing string section, wherein said means includes an annular element which is movably-attached to each of the adjacent mating flanges by threaded engagement.

5. In a subsea well apparatus having a riser conduit section having a mating flange at each end, mating flange end surfaces adapted for mating connection with adjacent riser conduit sections, tubing string-receiving orifices axially-disposed within the mating flanges, and one or more tubing string sections with the tubing string ends disposed within the orifices in each mating flange, each tubing string end having a tubing string end surface wherein the improvement comprises the provision of:

end portions on each of said tubing string sections which are shaped for free axial movement within each orifice; and means for axially adjusting the position of each of the end portions of the tubing string section within each orifice to selectively adjust the position of each tubing string end surface relative to the adjacent mating flange end surface.

6. In a subsea well apparatus having a riser conduit section having a mating flange at each end, mating flange end surfaces adapted for mating connection with adjacent riser conduit sections, tubing string-receiving orifices axially-disposed within the mating flanges, and one or more tubing string sections with the tubing strings ends disposed within the orifice in each mating flange, each tubing string end having a tubing string end surface wherein the improvement comprises the provision of:

end portions on each of said tubing string sections which are shaped for free axial movement within each orifice and which are provided with an outwardly-extending radial flange; and means for axially adjusting the position of each of the end portions of the tubing string sections within each orifice to selectively adjust the position of each tubing string end surface relative to the adjacent mating flange end surface, wherein the annular elements include two annular rings circumventing each tubing string section, each ring being disposed adjacent one of the radial flanges, and adapted to axially position said radial flanges.

7. In a subsea well apparatus having a riser conduit section having a mating flange at each end, mating flange end surfaces adapted for mating connection with adjacent riser conduit sections, tubing string-receiving orifices axially-disposed within the mating flanges, and one or more tubing string sections with the tubing string ends disposed within the orifices in each mating flange, each tubing string end having a tubing string end surface wherein the improvement comprises the provision of:

end portions on each of said tubing string sections which are shaped for free axial movement within each orifice and which are provided with an outwardly-extending radial surface; and means for axially adjusting the position of each of the end portions of the tubing string section within each orifice to selectively adjust the position of each tubing string end surface relative to the adjacent mating flange end surface, said means comprising two annular members disposed about each tubing string section, each annular member being adjacent one of the radial flanges, and adapted to axially position said radial flanges.

8. In a subsea well apparatus having a riser conduit section having a mating flange at each end, mating flange end surfaces adapted for mating connection with adjacent riser conduit sections, tubing string-receiving orifices axially-disposed within the mating flanges, and one or more tubing string sections with the tubing string ends disposed within the orifices in each mating flange, each tubing string end having a tubing string end surface wherein the improvement comprises the provision of:

end portions on each of said tubing string sections which are shaped for free axial movement within each orifice;

means for axially adjusting the position of each of the end portions of the tubing string section within each orifice to selectively adjust the position of each tubing string end surface relative to the adjacent mating flange end surface; and wherein the end portions of the tubing string sections are disposed in tubing string receiving orifices which are circumferentially offset so that each end of each tubing string section is axially-disposed within its orifice and the intermediate portion of each tubing string section partially circumvents the riser conduit section.

9. The subsea well apparatus defined in claim 8 wherein each tubing string section circumvents the riser conduit section by an amount between about 170° and 190°.

10. In a subsea well apparatus having:

a riser conduit section having a mating flange at each end with mating end surfaces adapted for mating connection with adjacent riser conduit sections, and a plurality of axial, tubing string receiving orifices circumferentially-disposed about each mating flange; and a plurality of tubing string sections, with each having one end disposed in an orifice in one mating flange and its other end disposed in an orifice in the other mating flange;

the improvement comprising the provision of:

end portions on opposite ends of the tubing string sections which are shaped for free axial movement within each orifice;

means for axially adjusting the position of the end portions of the tubing string within each orifice; and wherein the ends of each tubing string section are disposed in circumferentially offset orifices so that each end of each tubing string section is axially disposed within its orifice and the intermediate portion of the tubing string section partially circumvents the riser conduit section.

11. In a subsea well apparatus having a plurality of conduit sections connected in end to end array with a plurality of tubing strings associated with each of said sections, end portions of the tubing strings terminating adjacent the mating end surfaces of adjacent conduit sections and means for retaining said end portions adjacent said mating end surfaces, the improvement of a metal to metal sealing joint for a plurality of paired up end portions of said plurality of tubing strings which is effected between said conduit sections concurrently on connection of said conduit sections to each other comprising the provision of:

means for providing an annular inwardly tapered internal surface inwardly of each of said tubing string end portions; and a plurality of sleeve members having tapered ends, each of said members being of a size and being positioned between a pair of aligned tubing string end portions whereby, on connection of said adjacent conduit sections together, each said member is placed in a metal-to-metal sealing relation with its associated pair of tubing string end portions associated internal surfaces to thereby effect a concurrent joining of the plurality of tubing strings on said adjacent conduit sections.

12. The improvement in the subsea well apparatus of claim 11 wherein:

said means for retaining includes members for movably mounting each of the tubing string end portions for movement in an axial direction relative the associated conduit section whereby each of said annular inwardly tapered internal surfaces may be axially adjusted to facilitate their location for sealing on said sleeve members in said concurrent joining of said plurality of tubing strings on connection of said conduit sections.

13. A method of effecting a plurality of metal-to-metal sealing joints between a plurality of tubing strings connected to a pair of axially aligned and connected subsea well riser conduit sections with the tubing strings having end portions terminating in the conduit section ends comprising the steps of:

providing an annular inwardly tapered surface associated with each of said tubing string end portions and locating said surfaces relative the associated conduit section end;

locating a plurality of seal members of sleeve configuration with tapered opposite ends in a like plurality of said annular inwardly tapered surfaces located relative a first conduit section end with one member per annular surface;

aligning the tubing string annular surfaces associated with said first conduit section with annular surfaces associated with a second conduit section aligned with said first conduit section; and thereafter connecting said conduit sections together including the substep of effecting a concurrent joining of the plurality of tubing strings on said first conduit section with the aligned plurality of tubing strings on said second conduit section and placing said seal members in compression between aligned pairs of said tubing string associated annular inwardly tapered surfaces by said step of connecting said conduit section together.

14. The method of claim 13 including the additional step of:

adjusting the location of each tubing string end portion in a direction parallel to the axis of said conduit section end to selectably locate an associated annular surface relative said conduit section and preparatory to said substep of placing said seal members in compression between aligned pairs of said tubing string end portion associated internal surfaces.

15. In a subsea well apparatus having a plurality of conduit sections connected in end to end relation with a plurality of tubing string sections associated with each conduit section, end portions of the tubing strings terminating adjacent the mating end surfaces of adjacent conduit sections and means for retaining said end portions adjacent said mating end surfaces, the improvement in means for joining said tubing string end portions to provide a sealed fluid flow communication between aligned tubing strings on said adjacent conduit sections comprising the provision of:

a plurality of metal-to-metal type sealing sleeve members, each of said members being positioned between pairs of aligned and opposing end portions of the tubing string at said mating end surfaces of said adjacent conduit sections, said plurality of sleeve members being held in fluid sealing compression between said tubing string end portions by the connection of said adjacent conduit sections to one another.

* * * * *